US005394799A

United States Patent [19]

Rhodes et al.

[11] Patent Number: 5,394,799

[45] Date of Patent: Mar. 7, 1995

[54] ELEMENTS AND METHOD FOR POSITIONING AND IMMOBILIZING A PATIENT IDENTIFICATION BAND FOR IMPRINTING

[75] Inventors: David D. Rhodes, Cary; David L. Doerschner, Rolling Meadows, both of Ill.

[73] Assignee: Hollister Incorporated, Libertyville, Ill.

[21] Appl. No.: 54,392

[22] Filed: Apr. 28, 1993

[51] Int. Cl.[6] ..... B41F 21/00

[52] U.S. Cl. ..... 101/269; 101/407.1; 101/474; 248/201

[58] Field of Search ..... 101/3.1, 5, 35, 269, 101/407.1, 408, 413, 415, 474; 248/205.3, 201; 269/302, 900, 902

[56] References Cited

U.S. PATENT DOCUMENTS

| | | | |
|---|---|---|---|
| 1,534,751 | 4/1925 | Wallick | 101/415 |
| 1,686,924 | 10/1928 | Oberhauser | 101/474 |
| 2,148,563 | 2/1939 | Kingsley | 101/474 |
| 2,867,275 | 1/1959 | Laufer | 101/407.1 X |
| 2,982,205 | 5/1961 | Maul | 101/407.1 X |
| 3,654,858 | 4/1972 | Rick | 101/269 |
| 3,704,668 | 12/1972 | St. Onge et al. | 101/269 |
| 3,818,829 | 6/1974 | Patterson, Jr. | 101/269 |
| 4,083,302 | 4/1978 | Bello et al. | 101/269 |

*Primary Examiner*—Edgar S. Burr
*Assistant Examiner*—Christopher A. Bennett
*Attorney, Agent, or Firm*—Tilton Fallon Lungmus

[57] ABSTRACT

Retaining elements are disclosed for mounting on a platen of an imprinter in order to position and secure an identification band on the platen for an imprinting operation. Each retaining element comprises a base having a planar bottom surface and an upper surface generally parallel with the bottom surface and including a band support portion, an adhesive layer along the bottom surface for securing the retaining elements to the platen, and a cantilevered spring arm secured at one end to the base (and extending over the band support portion of the base). A pair of such elements are affixed in spaced relation on the platen on opposite sides of an imprinting zone so that an identification band can be slipped between the undersides of the spring arms and the support portion of the bases with the imprint-receiving portion of the band traversing the imprinting zone and, preferably, the clasp of the band engaging a side edge of one of the retaining elements. Each spring arm is adapted to engage a portion of the band and temporarily deform to exert a clamping force which immobilizes the band for imprinting.

11 Claims, 1 Drawing Sheet

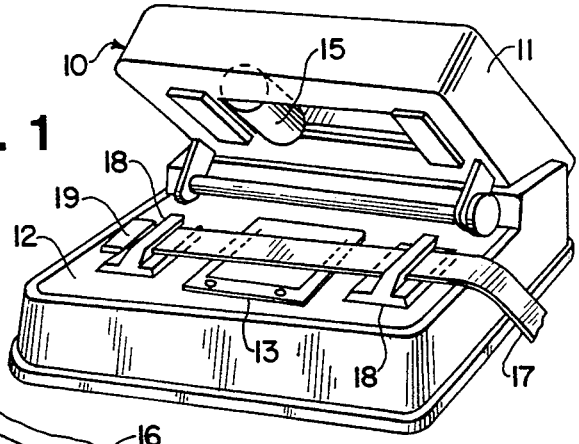
Fig. 1
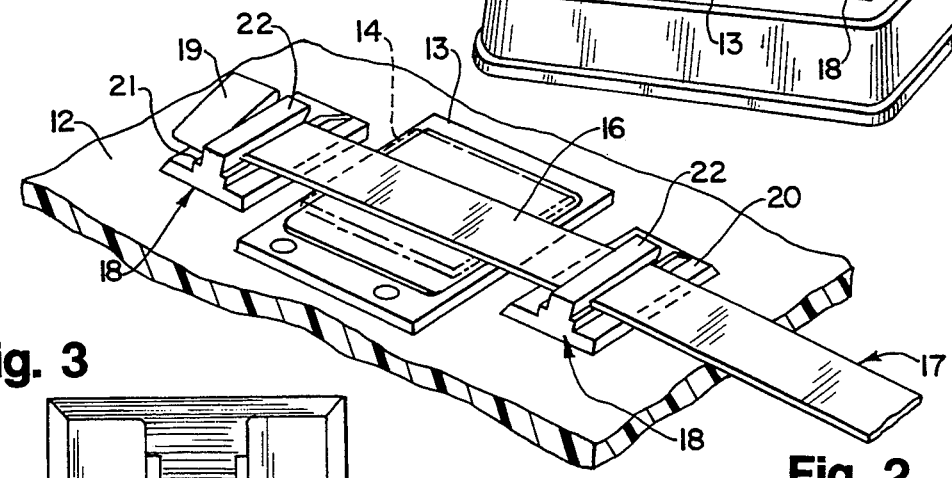
Fig. 2
Fig. 3
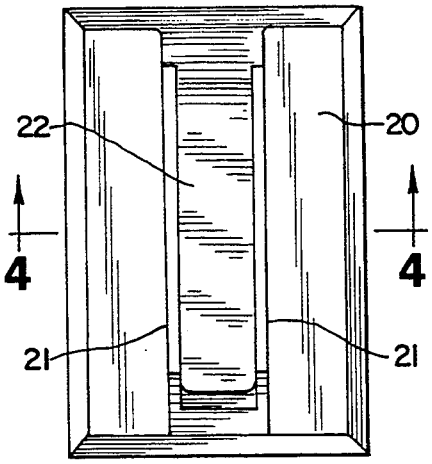
Fig. 6
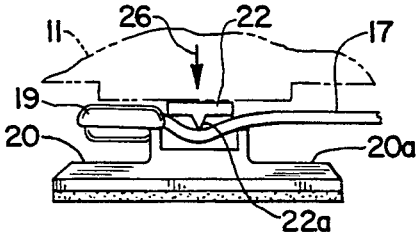
Fig. 4
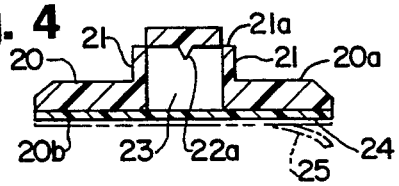
Fig. 7
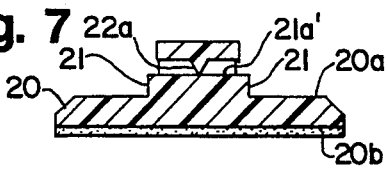
Fig. 5
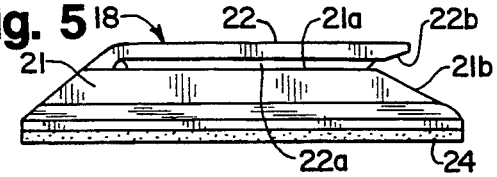
Fig. 8
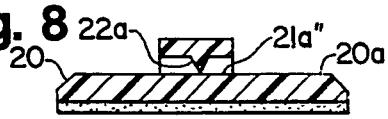

ELEMENTS AND METHOD FOR POSITIONING AND IMMOBILIZING A PATIENT IDENTIFICATION BAND FOR IMPRINTING

BACKGROUND AND SUMMARY

This invention relates to the field of printing devices and more particularly to identification band imprinters of a type commonly used in hospitals.

Printing devices are well known in the art and are widely used for imprinting credit card receipts, business forms and invoice slips. These devices typically have a platen upon which reusable plastic cards with raised characters providing the information to be imprinted may be placed. A cover with a roller carriage is connected to the platen such that the cover may be lowered and the roller may be passed over a form or slip positioned above (or below) the card to impress information from the card onto the form or slip. Typically, the business form or slip is held in place by locating the edges or corners of the form by means of guides as disclosed in U.S. Pat. Nos. 4,083,302 and 3,654,858. Other devices are known in the art which use spring clamps for forceably engaging and holding a business form or slip, such as disclosed in U.S. Pat. Nos. 3,818,829 and 3,704,668.

The present invention is particularly aimed at providing a retaining element for use in imprinting patient identification bands of a type widely used in hospitals. When a patient is admitted to a hospital, the patient's name and other personal data are typically entered on a plastic identification card (usually blue or green) having raised or embossed characters. This information is then imprinted onto a patient identification band (and onto a number of other hospital records) by using a roller-equipped imprinter of the general type described above. However, it is an all-too-common experience for such a band to slip when the cover is lowered and the roller is passed over the band, causing the impression to be marred or misplaced on the transfer surface of the band. Patient safety demands that the imprinted information be clearly legible, so bands with marred or misplaced information are commonly discarded and the process is repeated until satisfactory results are obtained. Such repetition obviously wastes material and consumes valuable time and effort of hospital personnel.

Accordingly, an important aspect of this invention lies in providing simple and inexpensive retaining elements for use with common roller-equipped imprinters for positioning and immobilizing patient identification bands for imprinting. Another objective of the present invention is to provide a simple means for positioning the identification band on an imprinter so as to prevent marred or misplaced information on the bands. A further objective of the invention is to eliminate wastage which results from discarding bands which have marred or misplaced information.

The present invention addresses the above problems and achieves the above objectives by providing a pair of retaining elements, each of which comprises a base having a planar bottom surface and an upper surface generally parallel with the bottom surface and including a band support portion, an adhesive layer along the bottom surface for securing the retaining elements to the platen, and a cantilevered spring arm mounted on the base and extending over the band support portion of the base. For use, the elements are affixed to the platen of the imprinter on opposite sides of the card-supporting and imprinting zone. A patient identification band is then slipped between the undersides of the spring arms and the band support portions of the bases of both elements. The underside of each spring arm is ideally provided with a longitudinal rib that has a lowest portion that is preferably coplanar with the support portions of the bases when the arm is in an unflexed state. When the band is inserted under the spring arm, the rib engages the band causing slight downward deformation of the band and upward flexing of the spring arm to exert a clamping force for holding the band in place. The clamping force could also be increased when the cover of the imprinter is closed to engage and press down on the upper contact surface of each spring arm that normally projects above the band support portions of the bases.

The retaining elements function as band positioning means as well as stabilizing or immobilizing means. Most advantageously, one of the elements is secured to the platen of the imprinter so that the clasp of an identification band engages a side edge of that element and secures the band against longitudinal movement in the direction of roller travel during an imprinting operation. A pair of such retaining elements may be easily and quickly mounted in proper locations on the platen of an imprinter simply by placing an identification band on the platen with its transfer surface precisely located over the imprinting zone and then positioning the retaining elements on opposite sides of that zone with portions of the band fully received beneath the spring arms and with one of the elements in lateral engagement with the clasp at one end of the band. Pressure-sensitive adhesive coatings on the undersides of the retaining elements, exposed by removing protective release sheets, securely fix the two elements in their selected positions on the platen.

The retaining elements of the present invention are inexpensive, easy to manufacture, and provide a secure means for locating and immobilizing an identification band on the platen of an imprinter for the transfer of information from an imprinting card to the transfer surface of the identification band.

Other features, advantages, and objects of the invention will become apparent from the specification and drawings.

DRAWINGS

FIG. 1 is a frontal view of an imprinter equipped with the retaining elements of the present invention.

FIG. 2 is a perspective view of the platen of the imprinter further illustrating the retaining elements in relation to a patient identification band.

FIG. 3 is an enlarged top view of a retaining element of the present invention.

FIG. 4 is a cross-sectional view taken at line 4—4 of FIG. 3.

FIG. 5 is a side view of the retaining element of the present invention.

FIG. 6 is a front view showing a retaining element in coaction with a patient identification band.

FIG. 7 is a cross-sectional view of a second embodiment of the retaining element of the present invention.

FIG. 8 is a cross-sectional view of a third embodiment of the retaining element of the present invention.

DETAILED DESCRIPTION OF PREFERRED EMBODIMENTS

In FIG. 1, numeral 10 generally designates a conventional imprinter having a cover 11 and a platen 12. A card holder 13 is disposed on the platen 12 to hold an imprinting card 14 (shown in phantom in FIG. 2) in place. The imprinter is operated by passing a roller 15 over the card 14 to transfer information represented by the raised letters, numerals, and/or other characters of the card 14 to an indicia-receiving portion 16 of an identification band 17. During the printing operation, when the roller 15 is passed over the band 17, retaining elements 18 exert a clamping force which immobilizes the band 17 in a precise location and prevents marring or misprinting of the information transferred from the card 14 to indicia-receiving portion 16. Besides exerting a clamping force on the band 17, the retaining elements 18 also immobilize the band 17 in a longitudinal direction due to the engagement of one of the retaining elements 18 and a metal clasp or buckle 19 disposed at one end of the band 17. Typically, identification bands used in hospitals have such a clasp or similar connecting means at one end so that the band 17 can be secured about a patient's wrist. In the imprinting operation, the band 17 should be positioned in the retaining elements 18 such that one side of the clasp 19 abuts against one of the retaining elements to help orient the band so that portion 16 is in proper position over card 14 and to contribute in preventing longitudinal movement of the band when roller 15 travels over the band 17.

FIG. 2 more clearly illustrates the platen 12 of the imprinter 10 and the engagement of the band 17 by the retaining elements 18. Each of the retaining elements 18 has a base 20 having a planar upper surface 20*a* and a planar bottom surface 20*b*, a pair of spaced vertical side walls 21, and an integral spring arm 22. The upstanding side walls define a recess 23 over which the cantilevered spring arm 22 extends and provide band support portions 21*a*. The present invention preferably incorporates recess 23 for ease of molding, manufacture and providing an area into which band 17 may deform. However, the invention is not so limited and recess 23 is not required as long as a support portion or portions 21*a* provide an area which will support an identification band in opposition to an underside 22*a* spring arm 22.

The recess in the preferred embodiment extends downwardly through the base 20 and the planar bottom surface 20*a* of the base is coated with a suitable pressure-sensitive adhesive 24 for securing each retaining element on the horizontal surface of the platen on opposite sides of the card-supporting surface portion of that platen. Any suitable pressure-sensitive adhesive may be used, such as an acrylic adhesive, and, if desired, other suitable means might be provided for securing the retaining elements to the platen surface. Where pressure-sensitive adhesive is used, the adhesive surface may be protected by a release sheet 25 (shown only in phantom in drawings) of siliconized paper or other suitable material, such sheet being removable to expose the adhesive surface when attachment of a retaining element to the platen surface is desired.

Referring to FIG. 5, it will be observed that the support portions 21*a* of side walls 21 are shown as straight upper edges that are parallel and extend in the same horizontal plane, and that the lower portion 22*a* of the underside of spring arm 22 is preferably coplanar with the support portions 21*a* of the side walls, when the spring arm 22 is in its normal untensioned or unflexed state. Consequently, when a patient identification band 17 is urged beneath the spring arm 22 and over the band support portions 21*a* of walls 21, a portion of the band is urged or deformed into the recess 23 below the level of support portions 21*a* (FIG. 6) as the arm is flexed slightly upwardly.

In the preferred embodiment shown, the portion 22*a* of spring arm 22 that is preferably coplanar with support surfaces 21*a* when the arm is in its untensioned or unflexed state takes the form of a longitudinal rib which is parallel with side walls 21 and spaced midway between those walls. The narrow contact surface of the rib, which acts as a force concentrating means, and the clamping force exerted by arm 22 increase the extent of band deflection or deformation and help to hold the band more tightly against the support portions 21*a*. The spring arm 22 can also be dimensioned so that its upper surface is contacted by the cover 11 of the imprinter when the cover is lowered as indicated in FIG. 6, the cover thereby exerting a downward force on the spring arm in the direction of arrow 26 to limit upward flexure of the arm when a band 17 is slipped into position and the cover 11 is lowered.

To facilitate insertion of a band 17 into position beneath spring arm 22, the free end of the arm may be provided with a sloping or chamfered surface 22*b* and the support portions of the side walls 21 may slope upwardly and rearwardly towards the spring arm as depicted in FIG. 5. Surfaces 21*b* and 22*b* thereby converge to guide insertion of a band into the clamped position illustrated in FIGS. 1 and 2.

Referring to FIGS. 7 and 8, alternate embodiments of the retaining elements are illustrated to show that the retaining elements do not require a recess 23. Rather, the important aspect of the invention is that the upper surface 20*a* of the base provide band support portions shown as 21*a*' and 21*a*''. These support portions provide support for the identification band in opposition to the underside of the spring arm but need not be formed about a recess —although such a structure is preferable for manufacturing reasons.

The retaining elements 18 may be formed of any tough, flexible material that provides spring arms 22 with enough flexibility to deform slightly when band 17 is inserted between those arms and support portions 21*a* to create a clamping force that will immobilize the band during an imprinting operation. A plastic material such as nylon or high impact polystyrene is believed particularly effective, but other materials having similar properties may be used.

The retaining elements 18 are secured to platen 12 along opposite sides of the card-receiving surface portion 13. To position such elements in the correct locations, a user first places an identification band 17 so that its indicia-receiving portion 16 overlies the card-receiving portion 13 of the platen. A pair of retaining elements 18 are positioned to receive portions of the band on opposite sides of the indicia-receiving portion 16 with a side wall 21 of one of the elements engaging the enlarged connecting portion or clasp portion 19 at one end of the band (FIG. 2). The release sheets are then simply removed from the retaining elements to expose the pressure-sensitive adhesive 24 and the retaining elements are adhered to the platen surface in their selected or predetermined positions. It will be observed that the band 17 extends in the direction of travel of the pressure roller 15 and that any force exerted by the roller tending to cause the band to slide longitudinally only forces clip 19 into tighter engagement with the side wall 21 of one of the elements. Thus, the elements 18 perform the dual functions of properly orienting an identification band, with a user simply inserting a band beneath spring arms 22 with the end clip 19 engaging one of the side walls 21 or a side edge of spring arm 22, and of immobilizing the band during an imprinting operation, with such immobilization occurring because of the spring action of the clamping arms 21, the deformation or deflection of those portions of the band into recesses 23 of the respective elements, and, in the case of a band having an enlarged clip or connecting portion 19, the engagement between that clip or connecting portion and side wall 21 or a side edge of spring arm 22.

While in the foregoing, we have disclosed embodiments of the invention in considerable detail for purposes of illustration, it will be understood by those skilled in the art that many of these details may be varied without departing from the spirit and scope of the invention.

We claim:

1. A retaining element for mounting on a platen of an imprinter in order to secure a flexible patient identification band in place for imprinting, said retaining element comprising a base having a planar bottom surface and an upper surface generally parallel with said bottom surface, said upper surface having a band support portion, means along said bottom surface for securing said retaining element to the platen of an imprinter, and a flexible, cantilevered spring arm mounted upon and extending over said base, said spring arm resiliently deforms exerting a clamping force on said identification band securing and immobilizing said band for imprinting, and means disposed on said spring arm for concentrating said clamping force on said band, said force concentrating means comprising a longitudinal rib extending from said underside of said spring arm for engaging said identification band and localizing the clamping force applied thereto.

2. The retaining element of claim 1 in which said means for securing said retaining element comprises a layer of pressure-sensitive adhesive material disposed on said bottom surface of said base.

3. The retaining element of claim 1 in which said spring arm has a chamfered free end for facilitating insertion of a band between said spring arm and said support portion of said base.

4. A retaining element for mounting on platen of an imprinted in order to secure a flexible patient identification,band in place for imprinting, said retaining element comprising a base having a planar bottom surface and an upper surface generally parallel with said bottom surface, said upper surface having a band support portion, means alonq said bottom surface for securing said retaining element to the platen of an imprinter, and a flexible, cantilevered spring arm mounted upon and extending a clamping force on said spring arm resiliently deforms exerting a clamping force on said identification band securing and immobilizing said band for imprinting, and means disposed on said spring arm for concentrating said clamping force on said band, said base having a first pair of side edges connecting said upper and bottom surfaces and said spring arm having a second pair of opposed side edges extending generally perpendicular to said underside, said first and second side edges being positioned to engage a clasp on said band when said band is pulled in a direction transverse to said first and second edges.

5. In combination, an imprinter having a platen providing a surface portion for supporting an embossed identification card and having a cover equipped with pressure roller means mounted for travel along a path of movement over said platen; a pair of retaining elements secured to said platen along opposite sides of said card-supporting surface portion thereof; each of said retaining elements having a planar bottom surface, an upper surface generally parallel with said bottom surface and means for securing said retaining elements to said platen, said upper surfaces each having a band support portion; each of said elements also having a cantilevered spring arm joined at one end to said base and having an underside spaced apart from and in opposition to said support portion so that when a band is slipped between said underside and said support portion, said spring arm resiliently deforms exerting a clamping force on said band securing and immobilizing said band in place for imprinting.

6. The combination of claim 5 in which said spring arm includes means for concentrating said clamping force on said band.

7. The combination of claim 6 in which said force concentrating means comprises a longitudinal rib extending from said underside of said spring arm for engaging said identification band and localizing a clamping force applied thereto.

8. The combination of claim 5 in which said means for securing said element to said platen comprises a layer of pressure-sensitive adhesive disposed on said bottom surface of said elements.

9. A method of positioning and immobilizing a flexible patient identification band for the imprinting of indicia thereon by means of a conventional imprinter having a cover equipped with a pressure roller mounted for travel along a horizontal path and a platen having a horizontal card supporting surface for holding an embossed identification card along the path of travel of said roller; said band having an intermediate indicia-receiving portion and a clasp portion at one end thereof; wherein said method comprises the steps of securing a pair of retaining elements on said platen in selected positions on opposite sides of said supporting surface; each of said elements having a base attachable to said platen, said base having a planar bottom surface and an upper surface generally parallel with the bottom surface and including a band support portion, and a cantilevered spring arm extending over said band support portion of said base, said securing step including the positioning of said elements on said platen so that said spring arms of the respective elements extend in the same direction transversely with respect to a band retainable by said elements when said band is oriented with its indicia-receiving portion overlying an embossed card on said card supporting surface, and clamping said band between said spring arms and said band support portions to position and immobilize said indicia-receiving portion between said elements and along said path of travel of said roller; and thereafter closing said cover and operating said imprinter to imprint said band while said indicia-receiving portion thereof is so positioned and immobilized.

10. The method of claim 9 in which said securing step comprises adhesively securing said retaining elements to said platen.

11. The method of claim 10 in which said securing step includes positioning one of said elements on said platen so that a side edge of said spring arm and a side edge of said base are positioned to engage the clasp of a band when said band is properly clamped between said spring arms and said band support portions of said bases.

* * * * *